United States Patent [19]

Raftery et al.

[11] 4,265,483

[45] May 5, 1981

[54] MODULAR SEATING ARRANGEMENT

[75] Inventors: William B. Raftery, Ann Arbor; Ronald L. Whitwam, Caledonia; Joseph M. Wisniewski, Marne, all of Mich.

[73] Assignee: Steelcase Inc., Grand Rapids, Mich.

[21] Appl. No.: 47,110

[22] Filed: Jun. 11, 1979

[51] Int. Cl.[3] ..... A47C 7/02

[52] U.S. Cl. ..... 297/440; 297/445; 297/232

[58] Field of Search ..... 297/440, 445, 446, 443, 297/294, 295, 232, 248

[56] References Cited

U.S. PATENT DOCUMENTS

| | | | |
|---|---|---|---|
| 3,310,343 | 3/1967 | Schultz | 297/445 |
| 3,677,601 | 7/1972 | Morrison et al. | 297/445 |
| 3,874,729 | 4/1975 | Blodee | 297/445 |
| 4,097,089 | 6/1978 | Petersen | 297/445 |

*Primary Examiner*—Francis K. Zugel

*Attorney, Agent, or Firm*—Price, Heneveld, Huizenga & Cooper

[57] ABSTRACT

The specification discloses modular seating in which interchangeable arm and armless end frames include a common rear frame portion joined to each respective front frame portion in butt wise fashion to give an integrated rather than tacked on appearance. The arm and armless end frames both have arcuately inturned rear portions and the armless has a similar arcuately inturned front portion for joining to front and rear cross supports. In contrast, the upwardly extending front leg of the arm frame includes an inwardly projecting bracket for joining to the front cross support and a sleeve on the bracket compensates for the length of the inturned front portion of the armless frame. Since the front and rear cross supports are at different levels, a leveling bracket or apron having triangular shaped sides is mounted between the front and rear cross supports to levelly support a table top thereon.

23 Claims, 4 Drawing Figures

MODULAR SEATING ARRANGEMENT

BACKGROUND OF THE INVENTION

The present invention relates to furniture construction, and in particular to a modular seating arrangement for constructing armed, one armed, two armed, and multiseat chairs.

The use of standarized modules to fabricate various seating arrangements has long been recognized as an effective means to reduce the overall cost of furnishings, particularly for commercial seating, such as that used in offices, airports, train depots, and other similar establishments. In such modularized designs, the various parts of the seating, such as the end frames, cross braces, seats, and backs, are designed to be easily interconnected with other seating members, even when the seating parts are interconnected in a variety of different configurations. By reducing the number of parts necessary to fabricate a given number of seating arrangements, the production costs of the seating parts can be reduced, the inventory cost for new and repair parts is lowered, and the time, complexity and expense for assembly of the seating is typically decreased. Hence, a substantial savings can be realized if a single part can be used in more than one place on the same chair configuration, and/or in a variety of seating applications.

Although modularized seating is advantageous in reducing furniture costs, prior art modular seating has tended to present a tacked together look rather than a smooth, sleek, eye-appealing design. Such seating has employed protruding joints and couplings to interconnect the various parts, thereby producing a rather unattractive, obtrusive style, which is typically perceived as merely collection of "add-on" parts. Often, such seating comprises a plurality of seats perched on a rail, like birds on a telephone wire.

Typically, arm and armless versions of prior art modular seating require different and frames entirely on other different components to assemble. Alternatively, the arms are merely tacked onto the armless version and the appearance of the seating distinctly betrays this fact.

SUMMARY OF THE INVENTION

The present invention provides a modular seating arrangement having a reduced number of component parts, and a sleek, attractive appearance. The modular seating arrangement includes armless and armed end frames which share a common component and yet the arm version is not merely a tack on to the armless. The rear frame portion is common to both and includes a forwardly extending runner portion. This butts a rearwardly extending runner portion of either the arm or armless front frame portion whereby an integrated rather than a tacked on appearance is achieved.

In another aspect of the invention, the arm and armless end frames each have an arcuately inturned rear end and the armless also has an arcuately inturned forward end for joining front and rear cross supports. Because the arm frame forward leg extends up to arm level and joins the arm portion, it includes a bracket projecting inwardly therefrom at the same level as said arcuately inturned forward end of said armless frame whereby the two can be interchanged using the same forward and rear cross supports. Preferably, a spacer fits over the arm frame bracket to compensate for the length of the inturned portion of the armless frame forward end, whereby the same forward cross support will be properly located on the arm frame brackets and the arm frame brackets will be totally concealed.

In yet another aspect of the present invention, the forward cross brace is disposed at an elevation higher than the rearward cross brace, whereby the seat is inclined downwardly from a front edge thereof. A table top is provided which extends between the cross braces and is supported thereon at a position adjacent to the seat. A leveling bracket connects the table top with the cross braces, and retains the same in a substantially horizontal orientation. The leveling bracket includes a pair of triangularly shaped side walls depending from the table top, and a back panel which supports the table top and substantially enclose the gap formed between the bottom surface of the table top and the cross braces thereby providing clean-cut design lines.

These and many other important advantages of the invention will be further understood and appreciated by those skilled in the art by reference to the following written specification, claims and appended drawings.

DETAILED DESCRIPTION OF THE PREFERRED EMBODIMENTS

Figure 1:
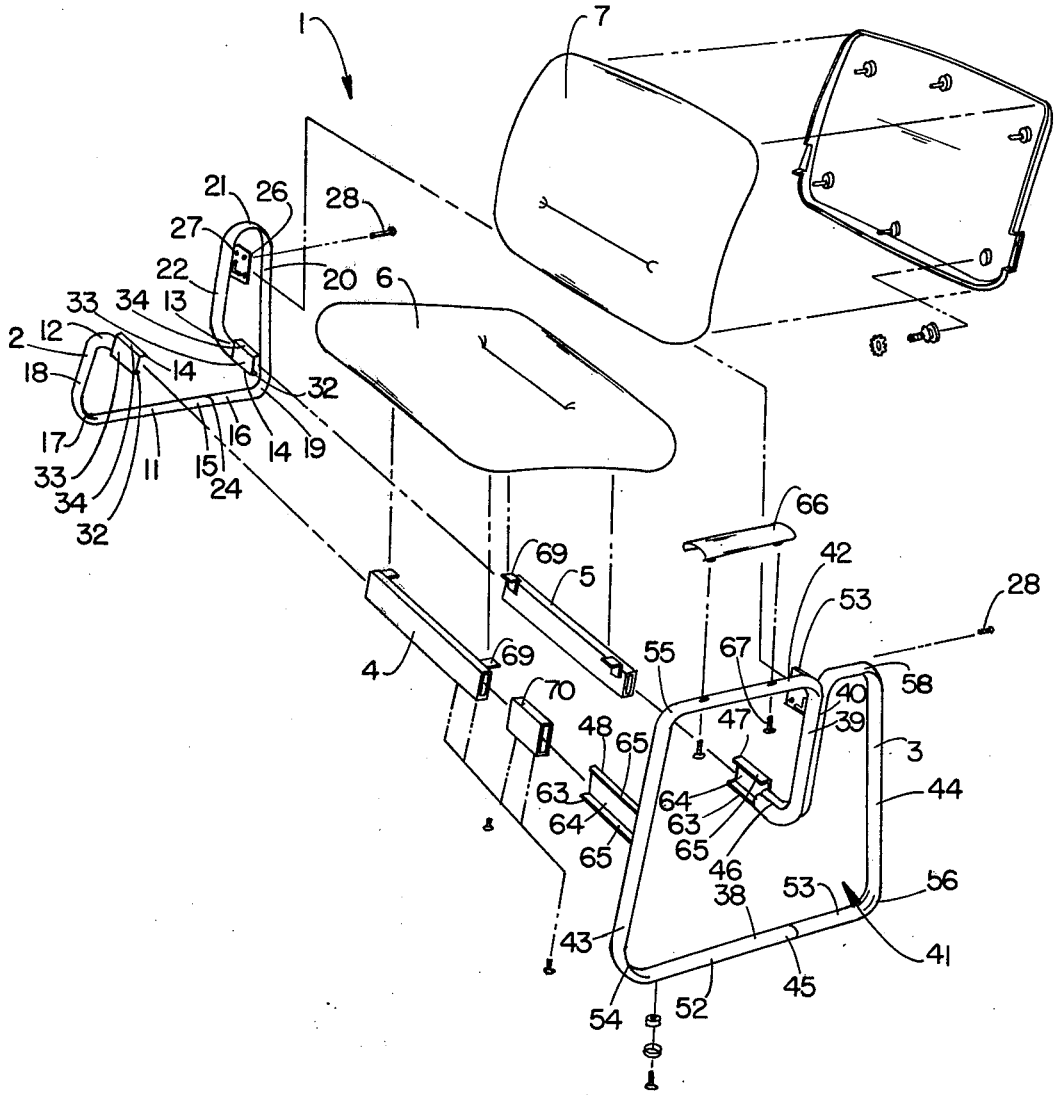
FIG. 1 is an exploded, perspective view of an embodiment of the modular seating arrangement manifesting the present invention.

The reference numeral 1 generally designates a modular seating arrangement embodying the present invention, comprising armless end frames 2, and armed end frames 3 which are interconnected by a pair of transversally extending cross braces 4 and 5. A seat 6 is connected with and supported by the cross braces 4 and 5, and a chair back 7 is connected between the end frames to comfortably seat an individual thereon.

The present invention contemplates providing a plurality of the armless end frames 2 in both left and right hand configurations, wherein each have a medial portion 11 which is adapted for engaging the ground or other supporting surface (with provision of glides usually) such as the floor, or the like, and first and second free end portions 12 and 13 respectively which are bent arcuately and inwardly of the medial portion 11, and include connecting means 14 thereon. In the illustrated example, the armless end frames 2 have a two-part construction, comprising forward and rearward members 15 and 16 respectively which are interconnected at the medial portion for purposes to be described in greater detail hereinafter. Both the forward and rearward frame members 15 and 16 respectively are preferably constructed of a single segment of tubular material which is bent into the desired shape. The medial portion 11 of the armless end frame is substantially rectilinear in shape, and the forward member 15 thereof is bent arcuately and upwardly at the corner 17 to form a forward leg 18, which at an uppermost portion thereof is in turn formed inwardly to shape the first free end portion 12 of the armless end frame. The rearward frame member 16 also includes a rectilinear base runner portion which is bent arcuately and upwardly at corner 19 to form a rear frame leg 20, which in the assembled state, has a substantially vertical orientation. The upper end 21 of the rear leg 20 is bent forwardly and arcuately, and thence downwardly to form a depending back support 22, which in turn is formed inwardly at the lowermost end to produce the second free end portion 13 of the armless end frame. The front leg 18, rear leg 20 and depending back support 22 are preferably each disposed along a common, substantially vertically oriented plane, and the first and second end portions 12 and 13 extend inwardly and equidistantly from the vertical plane of said leg and arm frame members.

Figure 2:
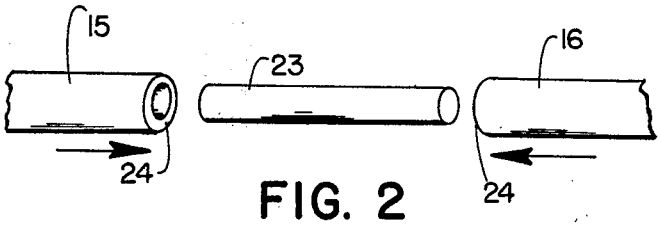
FIG. 2 is a fragmentary view of an end frame base portion of the seating arrangement, shown in a disassembled condition.
Figure 3:
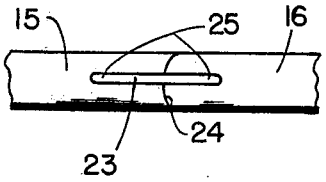
FIG. 3 is a fragmentary view of the end frame base, shown in an assembled condition.

The forward and rearward end frame members 15 and 16 are rigidly interconnected to form a sturdy end frame. In the structure illustrated in FIGS. 2 and 3, the frame medial portions are tubular, having a cylindrical oval tube shape, and a rigid pin 23 is inserted telescopically into the central aperture of each opposing frame member free end 24. Specifically, rear frame portion 16 includes a forwardly extending runner portion which is of the same lateral cross sectional configuration as a rearwardly extending runner portion on front frame portion 15. Pin or dowell 23 fits into the ends of these two runner portions and they are slid together to abutment at seam 24.

The pin 21 is attached to the mating frame member free ends by any suiteable means, such as the illustrated slot and weld arrangement 25, which is disposed on the lower surface of the frame medial portion, so as not to detract from appearance of the chair. Weld is applied through apertures 25 in the front and rear runner portions to weld the runner portions to pin 23. The free ends 24 of the end frame members are preferably joined together at the ground engaging base portion of the frame, and at a position thereon disposed substantially directly underneath the depending back support 22, such that the end frame can achieve the above described two-part construction, without impairing the strength or the rigidity of the overall end frame structure.

In this example, the depending back support portion 22 of the armless end frame 2 includes a fastening plate 26 which extends inwardly therefrom, and is adapted to attach the chair back 7 thereto. The fastening plates 26 extends directly inwardly from the outside surface of the depending arm 22, and includes a plurality of apertures 27 therethrough which are shaped to receive fasteners therein, such as the illustrated threaded screw 28, to attach the chair back 7 to the selected end frames.

In the illustrated structure, the connecting means 14 which is provided on the first and second free end portions 12 and 13 of the armless end frame 2 comprises a segment of U-shaped channel 32 having a vertically oriented web 33 and flanges 34 attached to the upper and lower surfaces thereof and acting as a projecting post. The longitudinal axis of each of the channel members 32 is preferably oriented in a horizontal plane, and the axes assume a mutually parallel relationship.

The armed end frame members 3 are also provided in left hand and right hand configurations, and each includes a medial portion 38 which is adapted to abuttingly engage the supporting surface. The armed end frame also includes first and second end portions 39 and 40 which are interconnected to form a loop 41 including an arm 42, front and rear legs 43 and 44 respectively, and a base 45. The first and second end portions 39 and 40 depend from the loop arm 42 and include free end portions 46 which bend arcuately and inwardly of the loop 41, and have connecting means 47 thereon. The front leg 43 of the armed end frame 3 includes a bracket 48 which extends inwardly of the loop 41 to facilitate connecting one armed end frame with another end frame. The bracket 48 and the free end portions 46 of the armed end frame 3 have an elevation and mutual or relative spacing which is substantially commensurate with the first and second end portions 12 and 13 of the armless end frame 2 respectively, whereby corresponding right and left hand end frames are interchangeabl, yet present a sleek, attractive seating design.

In this example, the armed end frames 3 have a two-part construction, which is substantially similar to the previously described two-part construction of the armless end frames 2, and comprises forward and rearward members 52 and 53 respectively, which are interconnected at the runner or base 45 of the loop 41 in the same manner as runner portions forward and of rear armless frame members 15 and 16 are joined. In fact, rearward member 53 of arm frame 3 is identical to rear member 16 of armless frame 2 except that as shown, it is the mirror image thereof since armless end frame 2 is a right hand member and arm frame 3 is a left hand member. For the same hand, members 53 and 16 would be identical. The base 45 of the loop has a substantially rectilinear shape, and extends to a forward, arcuately curved corner 54 of the forward frame member 52, from whence the same extends in an upright direction to form the front leg 43. The front leg 43 is inclined slightly rearwardly, and extends to an upper rounded corner 55, and thence extends horizontally to form the arm member 42. The rearward portion of the arm 42 is bent downwardly to form the depending first end portion 39, which is in turn connected with the connecting means 47. The base portion of the rearward member 53 is also rectilinear in shape, and curves upwardly at a rear corner 57 thereof to form the rear leg 44. The rear leg 44 is substantially vertically oriented, and at an upper corner 58 thereof is arcuately bent along a substantially horizontal plane at an elevation substantially commensurate with that of the arm 42, and is thence formed downwardly to produce the second frame end portion 40. The first and second end portions 39 and 40 of the armed end frame may be interconnected by any suitable means, such as threaded fasteners, but are preferably welded together.

The connecting means 47 mounted on the free end portions 46 of the armed end frames and the brackets 48 are preferably substantially identical with the previously discussed connecting means 14 for the armless end frame 2, and are positioned at a substantially identical forward and rearward elevation. The illustrated connecting means 47 and bracket 48 comprise a U-shaped channel member 63 having a web 64, and end flanges 65, which are shaped and interconnected substantially identically with the channel 32. In the illustrated example, an arm rest 66 is attached to the upper surface of the arm 42 by a pair of threaded fasteners 67 for improved user comfort, and a foot assembly 68 is provided at a forward portion of the base 45.

The cross braces 4 and 5 are disposed forwardly and rearwardly respectively of the chair assembly, and extend transversely between selected ones of the right and left hand seat frame, and include end portions with means thereon which interconnect and retain the selective seat frames in a spaced apart and substantially vertical orientation. In this example, the forward and rearward cross braces 4 and 5 each include channeled end portions which telescopically receive the projecting channel member 32 or 63 therein. The illustrated cross braces have a tubular construction, wherein the interior cavity thereof has a shape which mates with the projecting channel arrangements 32 and 33 and retains the end frames in a substantially parallel, vertical orientation. The cross braces 4 and 5 to be used at the forward and rearward portions of the end frames are preferably identical in length and shape so as to be interchangeable, and are also capable of interconnecting any selected right and left hand end frame for reduced manufacturing, assembly, and repair costs. The illustrated cross braces 4 and 5 have a substantially identical design with a rectangular transverse cross sectional shape, and a pair of L-shaped apertured brackets 69 attached adjacent each end thereof to connect the seat 6 thereto, and may be used at either the forward or rearward positions to interconnect either armed or armless end frames. Because of the inwardly extending arcuate free end portion 46 of the armed end frame, when the armed end frame is used in conjunction with a chair construction wherein the forward and rearward cross braces 4 and 5 are interchangeable, the forward cross brace 4 will not be sufficiently long to extend entirely between the front leg 43 of the armed end frame, and the associated portion of the other end frame. In such instances, spacer 70 is provided, and is shaped to encase an innermost portion of the bracket 32 to center the forward cross brace, prevent disengagement from the bracket and provide an attractive, fluent appearance. The spacer 70 has an interior cavity shaped to mate with the bracket 48 and be received in a telescoping fashion thereover, and an exterior surface substantially identical with the outer surface of the forward cross brace 4. The illustrated spacer 70 has a tubular construction with a rectangular transverse cross sectional shape identical with that of either standard cross braces 4 and 5. In the construction of a two-armed chair, a spacer 70 is provided on each of the brackets 48.

Figure 4:
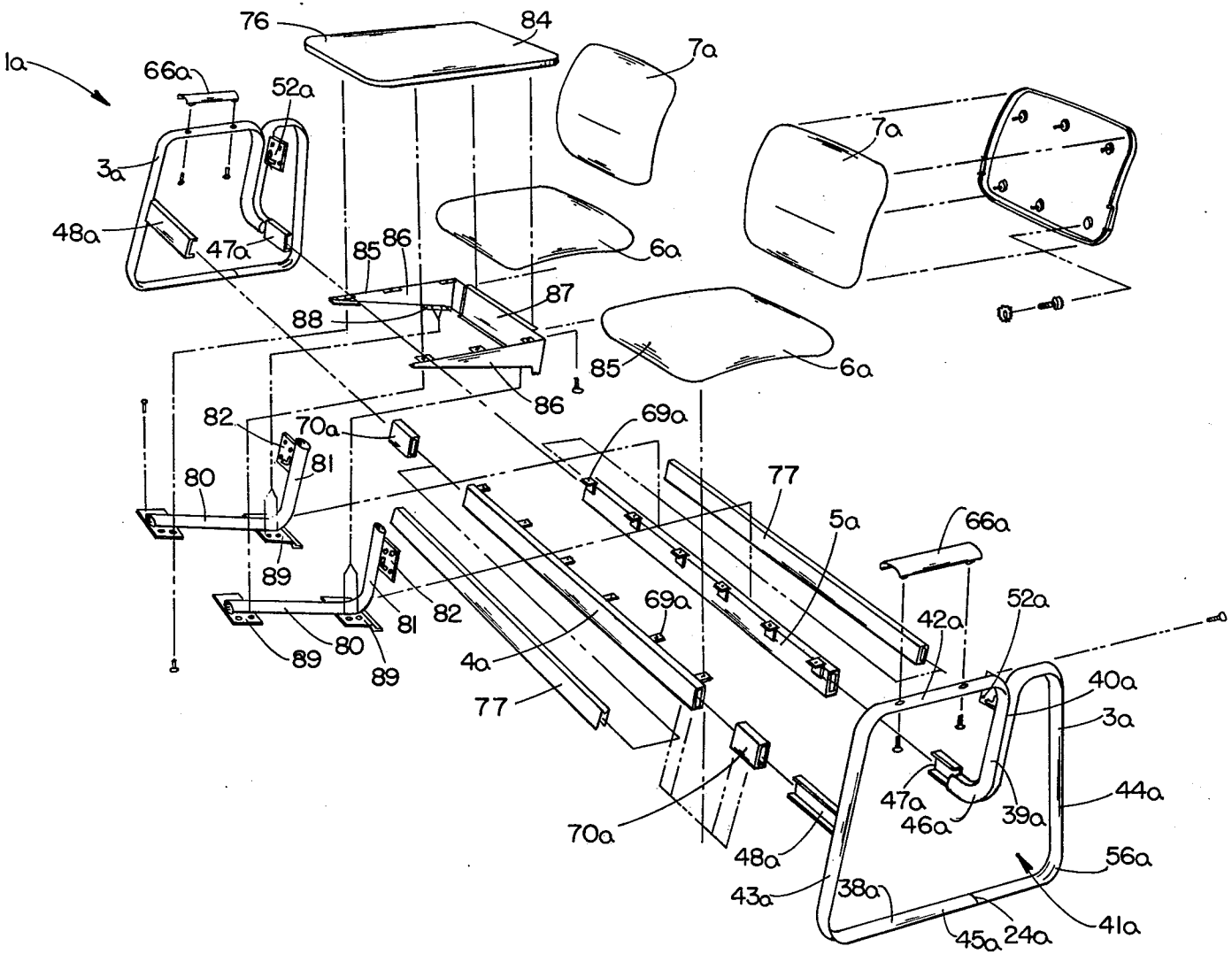
FIG. 4 is an exploded perspective view of another embodiment of the present modular seating arrangement, particularly showing a multi seat configuration with a table top connected therebetween.

The reference numeral 1*a* generally designates a multi-seat embodiment of the present invention, which as illustrated in FIG. 4, includes a table top mounted adjacent the seats. Since the multi-seat embodiment of the present invention is substantially similar as the previously described modular seating arrangement, similar parts appearing in FIGS. 1–3 and 4 respectively are represented by the same, corresponding reference numeral, except for the suffix "a" in the numerals of the latter. The forward and rearward cross braces 4*a* and 5*a* are elongate and adapted to retain a plurality of seats 6*a* thereon, as well as a table top assembly 76. The illustrated structure includes a pair of seats 6*a* which are mounted adjacent to opposite ends of the cross braces 4*a* and 5*a* next to the corresponding end frames 3*a*. The table top assembly 76 is positioned between the seats 6*a* for convenient access from either chair. The illustrated cross braces 4*a* and 5*a* have a hollow channel construction with a rectangular transverse cross sectional shape, and a pair of reinforcing beams 77 are telescopically inserted within the cross braces 4*a* and 5*a*, and provide additional rigidity to the seating arrangement.

In this example, both of the end frames are armed, and a spacer 70*a* is positioned on the innermost portion of each of the support brackets 48*a* to center the forward cross brace and present a neat, attractive appearance. A pair of supports 80 are connected with the cross braces 4*a* and 5*a* adjacent the interior edge of each of the seats 6*a*, and includes an upstanding column portion 81 having a fastener member, substantially similar in construction to fastener plate 26, which extends outwardly thereof to provide means for supporting the interior sides of the chair backs 7*a*. The chair backs 7*a* extend between the fastening members 26*a* and 82 and are connected therewith by suitable fastening means.

The seats 6*a* are preferably inclined slightly downwardly from the forward edge 85 thereof, for improved seating comfort. To accomplish this seat angle, in the illustrated structure, the forward cross brace 5*a* is disposed at an elevation slightly above that of the rearward cross brace 5*a*.

The table top assembly 76 includes a top member 84 having a smooth, planer upper surface, and is connected to the cross braces 4*a* and 5*a* by a leveling bracket 85 which positions the table top in a substantially horizontal orientation, as well as securely connects the same with the cross braces. The leveling bracket 85 includes a pair of substantially triangularly shaped side walls 86 which depend downwardly from the top 85, and a back panel 87 which interconnects the side walls 86 along the shortest legs thereof, and is positioned adjacent the rearward cross brace 5*a*. The leveling bracket 85 is connected with the cross braces 4*a* and 5*a* by suitable fastening means, and in the illustrated structure, includes apertured flanges 88 which meet with corresponding apertured connecting flanges 89 on the lower surface of the chair back braces 80. The leveling bracket 85 both supports the table top 84 and substantially encloses the gap formed between the table top and the cross braces 4*a* and 5*a* to impart an attractive appearance thereto.

In use, the modular seating arrangement can be used to construct unarmed, one armed, two armed, and multi-seat chairs. To construct a single, armless chair, the assembler simply selects a left hand and right hand armless end frame 2, and a pair of standard cross braces 4 and 5 for connection with the rearward and forward portion of the end frames. The cross braces are inserted telescopically over the connecting brackets 14, thereby interconnecting the end frames and retaining the same in a spaced apart, substantially vertically oriented relationship. The seat 6 is connected with the cross braces, and the back 7 is connected with the fastening plates 26.

A single, two-armed chair is constructed in a similar fashion, and includes selecting left and right hand armed end frames 3, a pair of cross braces 4 and 5, and a pair of spacers 70. The spacers 70 are inserted over each of the brackets 48 and are positioned at an innermost portion thereof adjacent the front leg 43, such that only the outwardly most free end of the bracket 48 extends from the spacer 70. The cross braces 4 and 5 are then inserted telescopically over the free end of the bracket 48 and the connecting member 47, thereby interconnecting the armed end frames, and retaining the same in a spaced apart and substantially vertically oriented relationship. The seat 6 is then connected with the cross braces 4 and 5, the back is fastened to the fastening plates 53, thereby completing the chair construction.

Other chair configurations, such as one-armed chairs, can be constructed in a manner similar to that previously discussed, by simply selecting a right hand and left hand end frame having the desired shape, and interconnecting the selected end frames by a pair of cross braces 4 and 5. Because the elevation and spacing of the connecting members on each of the end frames is the same, the standard cross brace 4 and 5 may be used to interconnect any selected pair of right and left hand end frames. When the cross braces are used to connect an armed end frame, 3, a spacer 70 must be positioned over the innermost portion of the bracket 48 to center the forward cross brace, and impart and attractive appearance thereto. As a result of the arcuate shape of the frame member ends 12, 13 and 46, the spacer and bracket arrangement 48 and 70, and the respective positioning of the same, the armed and armless end frames are interchangeable, yet present sleek, fluent seating design lines with the appearance of an integral construction, and the cross braces 4 and 5 are interchangeable and capable of interconnecting any two end frames to construct a variety of eye-appealing chair configurations with a minimum number of different chair parts. The inwardly curved frame member ends 12, 13 and 46 also provide a lightweight economical, and sturdy construction which is substantially free of sharp corners for improved safety during use.

A multi-seat arrangement, such as that illustrated in FIG. 4, is also constructed in a fashion similar to the above described arrangement. The length of the standard cross braces 4*a* and 5*a* is selected in accordance with the type of seating configuration desired, and either armed or armless end frames are connected therewith. The seats and seat backs 6*a* and 7*a* and the table top assembly 76 are arranged on the cross braces 4*a* and 5*a* in the manner desired by the user, and are then attached thereto. Because the seating arrangement of the present invention is modular in nature, any particular configuration can be completely disassembled, and the parts used to construct a completely different seating arrangement.

It is to be understood that while we have illustrated and described certain forms of our invention, it is not to be limited to the specific forms or parts herein described and shown, except insofar as such limitations are included in the following claims.

The embodiments of the invention in which an exclusive property or privilege is claimed are defined as follows.

1. A modular seating system including at least one chair seat means, a pair of left and right end frames selected from arm and armless end frame alternatives, said end frames being located on either side of said seat means, and cross support means secured to and extending between said end frames and supporting said seat means, the improvement in said modular seating system comprising:

each of said right and left arm and armless end frames respectively including an identical rear frame portion defining at least a rear leg and a forwardly extending runner portion;

each said arm frame also including a forward frame portion defining an arm, a forward leg and a rearwardly extending runner portion, said rearwardly extending runner portion and said forwardly extending runner portion having a common lateral cross sectional configuration and being secured together in abutted relationship to give the appearance of a continuous frame runner extending from said rear leg to said front leg;

each said armless end frame also including a forward frame portion defining a forward leg and a rearwardly extending runner portion, said rearwardly extending runner portion also having a common lateral cross sectional configuration with said forwardly extending runner portion and being secured in abutted relationship to said forwardly extending runner portion to give the appearance of a continuous frame runner extending from said rear leg to said front leg whereby said arm and armless end frames can be made using a common rear frame portion and yet have an integral rather than tacked on appearance.

2. The modular seating system of claim 1 in which said rear frame portions and said forward frame portions of said arm and armless end frames have a tubular lateral cross section.

3. The modular seating of claim 2 in which said forward frame portions of said arm and armless end frames are secured to their respective rear frame portions by means of a dowell extending partially into the abutting tube ends of the front and rear runner portions.

4. The modular seating system of claim 1 in which there is an aperture in the bottom of each front runner portion in each of said armless and arm front frame portions, and an aperture in the bottom of the runner portions in said rear frame portions, said apertures being located in alignment with said dowells when said front and rear portions are in abutted relationship, said dowells being steel and being held in place with respect to said front and rear runner portions by welding at said apertures.

5. The modular seating system of claim 1, 2, 3 or 4 in which each of said rear frame portions includes a free end bent arcuately and inwardly with respect to the plane defined by said rear leg and runner portion of said rear frame portion, said free end having connecting means thereon; said front armless frame portion also including a free end bent arcuately and inwardly of the plane defined by said front leg and said front runner portion and including connecting means thereon; said arm end frame front portion including a bracket extending inwardly from said front leg and including connecting means thereon; said bracket and said free end of said armless front end frame portion having an elevation commensurate with one another whereby corresponding right and left hand arm and armless end frames are interchangeable, yet still present a sleek, fluent seating design;

said cross support means comprising forward and rearward cross braces extending transversally between selected ones of said right and left hand end frames and including end portions joined to said connector means, said forward cross braces being connected to the forward frame portion of said arm and armless end frames and said rearward cross braces being joined to said connecting means on said rear frame portions.

6. An arrangement as set forth in claim 5 wherein:

said forward and rearward cross braces are interchangeable, having a substantially similar length and shape; and including:

a spacer shaped to encase an innermost portion of said bracket on said front arm end frame portion for centering said forward cross brace, preventing disengagement with an associated one of the brackets, and providing an attractive appearance.

7. An arrangement as set forth in claim 5 wherein:

said connecting means on said armless and armed end frames comprises a rigid post extending substantially horizontally of an associated one of said end portions;

each of said brackets and its associated connecting means comprise a rigid post extending substantially horizontally of an associated one of said armed frame front legs; and said forward and rearward cross braces each include tubular end portions which telescopically receive said posts therein and retain associated right and left hand end frames in a spaced apart and substantially vertical orientation.

8. An arrangement as set forth in claim 7 wherein: said forward and rearward cross braces are interchangeable, having a substantially similar length and shape; and including:

a sleeve shape for telescopic reception onto an innermost portion of said rigid posts projecting from the front legs of the armed end frame for centering said forward cross brace, preventing disengagement with an associated one of the brackets, and providing an attractive appearance.

9. A modular seating arrangement for constructing unarmed, one-armed, and two-armed chairs, said arrangement comprising:

right and left hand armless end frames, each having a medial portion adapted for engaging a supporting surface, and including front and rear legs having, first and second free end portions respectively bent arcuately and inwardly of the medial portion, and including connecting means thereon;

right and left hand armed end frames, each having a medial portion for engaging the supporting surface and first including front and rear legs, said rear leg including a free end portion which bends arcuately and inwardly of said medial portion and have connecting means thereon; said front legs each having a bracket extending inwardly thereof terminating in connecting means; said armed frame bracket and free end portion having an elevation and mutual spacing substantially commensurate with said armless frame first and second ends respectively, whereby corresponding right and left hand armed and armless frames are interchangeable yet present sleek, fluent seating design lines;

forward and rearward cross braces extending transversely between selected ones of said right and left hand end frames, and including end portions joined to said connecting means, thereby retaining said selected end frames in a spaced apart and substantially vertical orientation; and a seat extending between said cross braces and being supported thereon, whereby unarmed, one armed, and two armed chairs can be constructed by interconnecting selected pair of said right hand and left hand end frames with one of said forward and rearward cross braces, and by supporting said seat on said forward and rearward cross braces.

10. An arrangement as set forth in claim 9 wherein:

said forward and rearward cross braces are interchangeable, having a substantially similar length and shape; and including:

a spacer shaped to encase an innermost portion of said bracket for centering said forward cross brace, preventing disengagement with an associated one of the brackets, and providing an attractive appearance.

11. An arrangement as set forth in claim 9 wherein:

said connecting means on said armless and armed end frames comprises a rigid post extending substantially horizontally of an associated one of said end portions;

each of said brackets and its associated connecting means comprise a rigid post extending substantially horizontally of an associated one of said armed frame front legs; and said forward and rearward cross braces each include tubular end portions which telescopically receive said posts therein and retain associated right and left hand end frames in a spaced apart and substantially vertical orientation.

12. An arrangement as set forth in claim 11 wherein:

said forward and rearward cross braces are interchangeable, having a substantially similar length and shape; and including a sleeve shaped for telescopic reception onto an innermost portion of said rigid posts projecting from the front legs of the armed end frame for centering said forward cross brace, preventing disengagement with an associated one of the brackets, and providing an attractive appearance.

13. An arrangement as set forth in claim 9 wherein:

said armless end frames each include a depending back support having a back fastening member projecting inwardly thereof;

said armed end frames each include a back fastening member projecting inwardly of an upper portion of said armed end frame end portions; and including a chair back disposed between selected ones of said right and left hand end frames, and connected with the associated back fastening member thereon, whereby said chair back interconnects said selected end frames and prevents transverse movement therebetween.

14. An arrangement as set forth in claim 9 wherein:

said armless and armed end frames are each constructed of an elongate segment of tubular material.

15. An arrangement as set forth in claim 9 wherein:

said forward cross brace is disposed at an elevation higher than said rearward cross brace, whereby said seat is inclined downwardly from a front edge thereof.

16. An arrangement as set forth in claim 9 including:

a tabletop extending between said cross braces and supported thereon at a position adjacent to said seat.

17. An arrangement as set forth in claim 16 wherein:

said forward cross brace is disposed at an elevation higher than said rearward cross brace, whereby said seat is inclined downwardly from a front edge thereof, and including a leveling bracket connecting said tabletop with said cross braces for positioning said tabletop in a substantially horizontal orientation.

18. An arrangement as set forth in claim 17 wherein:

a gap is formed between the tabletop and the cross braces; and said leveling bracket includes a pair of triangularly shaped side walls depending from said tabletop, and a back panel interconnecting said side walls for substantially enclosing said gap and imparting a neat appearance thereto.

19. An arrangement as set forth in claim 18 wherein:

said cross braces are elongate and adapted to support a plurality of seats disposed thereon in a side-by-side relation.

20. An arrangement as set forth in claim 19 including:

first and second reinforcing beams connected with said forward and rearward cross braces respectively.

21. An arrangement as set forth in claim 19 including:

chair backs adapted for connection with said frame end members; and armless chair back supports disposed on interior sides of the seats of a multi-seat arrangement; each of said supports including a base portion extending between said forward and rearward cross braces with means for connection therewith; and an arm portion upstanding from said base portion and including means connecting an associated one of the chairs back therewith.

22. An arrangement as set forth in claim 9 wherein:

said right and left hand armless and armed end frames each have a two part construction comprising forward and rearward members interconnected at the medial portion thereof; and said rearward member of said armless and armed end frames have a substantially identical shape for corresponding right and left hand end frames, whereby the same are interchangeable.

23. A modular seating arrangement for constructing unarmed, one-armed, and two-armed chairs, said arrangement comprising:

right and left hand armless end frames, each having a medial portion adapted for engaging a supporting surface, and first and second free end portions bent arcuatly and inwardly of the medial portion and including connecting means thereon;

right and left hand armed end frames, each having a medial porton for engaging the supporting surface, and first and second end portions interconnected to form a loop including an arm, front and rear legs, and a base; said armed frame end portions depending from said loop arm and including free end portions which bend arcuately and inwardly of said loop, and have connection means thereon;

a cross brace extending transversely between selected ones of said right and left hand seat frames, and including end portions with means thereon interconnecting and retaining said selected seat frames in a spaced apart and substantially vertical orientation;

a seat supported on said cross brace; and wherein said right and left hand armless and armed end frames each have a two part construction comprising forward and rearward members interconnected at the medial portion thereof; and said rearward member of said armless and armed end frames have a substantially identical shape for corresponding right and left hand end frames, whereby the same are interchangeable.

* * * * *

UNITED STATES PATENT AND TRADEMARK OFFICE

CERTIFICATE OF CORRECTION

PATENT NO. : 4,265,483

DATED : May 5, 1981

INVENTOR(S) : William B. Raftery et al.

It is certified that error appears in the above—identified patent and that said Letters Patent is hereby corrected as shown below:

Column 1, line 39:

"and" should be --end--

Column 2, line 14:

"enclose" should be --encloses--

Column 3, line 30:

"suiteable" should be --suitable--

Column 3, line 46:

"plates" should be --plate--

Column 4, line 12:

"interchangeabl" should be --interchangeable--

Column 4, line 20:

"runner portions forward and of rear" should be

--the runner portions of forward and rearward--

Column 8, line 24:

"rear portions" should be --rear runner portions--

UNITED STATES PATENT AND TRADEMARK OFFICE

CERTIFICATE OF CORRECTION

PATENT NO. : 4,265,483

DATED : May 5, 1981

INVENTOR(S) : William B. Raftery et al.

It is certified that error appears in the above—identified patent and that said Letters Patent is hereby corrected as shown below:

Column 9, line 41:

"armless frames" should be --armless end frames--

Column 12, line 2:

"arcuatly" should be --arcuately--.

Signed and Sealed this

*Eighteenth* Day of *August 1981*

[SEAL]

*Attest:*

GERALD J. MOSSINGHOFF

*Attesting Officer*

*Commissioner of Patents and Trademarks*